United States Patent [19]

King

[11] Patent Number: 4,500,403

[45] Date of Patent: Feb. 19, 1985

[54] DIVIDED ELECTROCHEMICAL CELL ASSEMBLY

[75] Inventor: Christopher J. H. King, Pensacola, Fla.

[73] Assignee: Monsanto Company, St. Louis, Mo.

[21] Appl. No.: 511,810

[22] Filed: Jul. 8, 1983

[51] Int. Cl.[3] ..... C25B 9/00; C25B 11/02

[52] U.S. Cl. ..... 204/255; 204/257; 204/268

[58] Field of Search ..... 204/255, 256, 268-270, 204/254, 275-278, 260; 429/34, 39

[56] References Cited

U.S. PATENT DOCUMENTS

| | | | |
|---|---|---|---|
| 1,062,058 | 5/1913 | Threlfall | 204/268 |
| 1,541,947 | 6/1925 | Hartman | 204/269 |
| 1,674,364 | 6/1928 | Hartman | 204/269 |
| 3,113,918 | 12/1963 | Evans | 204/268 |
| 3,649,511 | 3/1972 | Danly et al. | 204/252 |
| 3,660,259 | 5/1972 | Danly et al. | 204/73 A |
| 3,669,869 | 6/1972 | Burton | 204/268 |
| 4,048,047 | 9/1977 | Beck et al. | 204/270 |
| 4,062,754 | 12/1977 | Eibl | 204/268 |
| 4,124,480 | 11/1978 | Stevenson | 204/268 |
| 4,193,858 | 3/1980 | Loeffler, Jr. | 204/268 |
| 4,203,808 | 5/1980 | Campbell et al. | 204/23 |
| 4,214,969 | 7/1980 | Lawrance | 204/255 |
| 4,323,444 | 4/1982 | Kawamura et al. | 204/269 |
| 4,407,904 | 10/1983 | Uozumi et al. | 429/26 |
| 4,413,041 | 11/1983 | Hegedus | 429/33 |

FOREIGN PATENT DOCUMENTS

| | | | |
|---|---|---|---|
| 2502840 | 7/1976 | Fed. Rep. of Germany | 204/268 |

*Primary Examiner*—Donald R. Valentine

*Attorney, Agent, or Firm*—Thomas Y. Awalt, Jr.

[57] ABSTRACT

A divided electrochemical cell assembly comprises stacked bipolar substantially square parallel planar electrodes and membranes. The corners and edges of the electrodes with bordering insulative spacers in juxtaposition with the chamber walls define four electrolyte circulation manifolds. Anolyte and catholyte channeling means permit the separate introduction of anolyte and catholyte into two of the manifolds and the withdrawal of anolyte and catholyte separately from at least two other manifolds. The electrodes and membranes are separated from one another by the insulative spacers which are also channeling means disposed to provide electrolyte channels across the interfaces of adjacent electrodes and membranes.

4 Claims, 2 Drawing Figures

DIVIDED ELECTROCHEMICAL CELL ASSEMBLY

BACKGROUND OF THE INVENTION

1. Field of the Invention

The invention relates to electrolytic cells for electrochemical synthesis.

2. Description of the Prior Art

Electrochemical devices employing stacked plates are well-known in the art. Conventional stacked plate cells include arrangements wherein planar electrodes of circular shape are located in an electrolyte chamber, spaced apart with radial insulating strips in the form of a stack, in which, with the exception of the outermost electrodes, each electrode acts both as anode and cathode. The electrolyte liquid is fed into the center of the stack so that it is operably exposed to the electrodes as it passes outwardly to the periphery of the electrodes. The spacing of the electrodes is fixed by radial strips of insulating non-swelling materials of the desired thickness.

The spacing of the bipolar electrode plates can vary within wide limits, but should be from 0.5 mm to 2 mm. This is because for many electrochemical reactions it is desirable to select a very small spacing so as to keep down the cell voltage and hence the power consumption, and to achieve a high space-time yield, and a low volume flow rate of the circulating electrolyte at a given flow rate.

The prior art teaches that the plates themselves can be circular, or approximately circular, and that a circular shape permits industrial manufacture of plates of high quality without great expense and makes it possible to get the electrode spacing to less than 1 mm.

With this type of cell construction, the liquid which externally surrounds the plate stack in operation is an electrical shunt, but this is a relatively unimportant factor in electrochemical synthesis if the plate thickness is large compared to the thickness of the capillary gap and can be made even less important if the electrode plates are each surrounded by tightly fitting rings of insulating material. Such a cell construction is taught in U.S. Pat. No. 4,048,047, in which a center feed was employed.

One of the major disadvantages of the stacked cell assembly with center feed, is that the electrode exposure to the electrolyte is not uniform in the sense that there is a greater electrolyte velocity along the inner portions of the electrodes than along the peripheral portions. This inevitably results in a dissimilar exposure pattern between the inner surfaces and the outer surfaces of the electrode. Wherever velocity affects product selectivity, of course, such variations in velocity may substantially affect overall selectivity or yield. In the cell with center feed, moreover, current leakage from within the center feed portion by way of an electrical shunt may be significant.

Another disadvantage of the stacked cell assembly with center feed is that its construction is not readily adaptable to a divided cell having a membrane separating the anolyte from the catholyte.

Since the electrochemical cell is of increasing interest commercially, an electrode arrangement which eliminates the above described disadvantages would represent a significant contribution and advancement in the art, and is an object of this invention.

More specific objects of this invention are specified below.

SUMMARY OF THE INVENTION

The invention is a divided electrochemical cell assembly comprising an essentially cylindrical electrolytic chamber. Within the chamber is a plurality of stacked bipolar substantially square parallel-planar electrodes and membranes. The electrodes and membranes are arranged in the chamber so that the corners and edges of the electrodes with bordering insulative spacers along with the walls of the chamber define four electrolyte circulation manifolds. Two of the manifolds are anolyte manifolds and two are catholyte manifolds. As seen at FIG. 1, between each membrane and the electrode next above which define catholyte channels (left to right) are at least two substantially parallel insulative spacers which hold the electrode membrane pair apart from one another, provide anolyte channels (front to rear) across the inner faces of adjacent pairs, and insulate portions of the electrode from the electrolyte. Anolyte and catholyte channels are alternating at right angles to one another, but parallel to other anolyte and catholyte channels, respectively. The outermost electrodes are monopolar, and all of the other electrodes are bipolar. The assembly provides for means for introducing the catholyte at one end of the chamber, and into one of the manifolds; and for exiting the catholyte at the other end of the chamber. It provides a similar arrangement for the anolyte.

BRIEF DESCRIPTION OF THE DRAWING

In the detailed description, reference will be made to the drawing in which.

Specific advantages of this invention over devices typical of the prior art include the following:

This type of design has a high specific electrode area, and in this particular cell design, may reach as high as 23 sq. ft./cubic ft. The fitting of electrode/membrane spaces is simple and they are kept in place by pack compression.

Since all of the sealing against the outside atmosphere is at the top, the bottom or the common wall, only low pressure sealing is required between the anolyte and catholyte flow tracks.

Electrodes and membranes can be pre-assembled in a frame for ready replacement of used electrodes.

Simple fabrication and the limited number of connecting parts make gasket replacement simple, and the replacement of damaged parts is facilitated.

The cell structure is inherently low in cost and more sensitive to the cost of electrode material.

Electrolyte flooded operation avoids possible detonation of gas spaces. Also, with minimal chance of electrolyte leakage, the fire hazard is minimized when the electrolyte contains flammables.

Specific advantages of this invention over such cells as taught in U.S. Pat. No. 4,048,047 include the following:

Materials are often available (or can be easily cut) as square planar sheets, not requiring fabrication.

In some electrode processes, electrolyte velocity influences product selectivity, and to the extent there are different velocities, there are variations in selectivity. This invention provides essentially uniform flow throughout.

The insulative cell spacer material can be extended in width to act as inlet and exit channels for adjacent cells, and thereby offer resistance to current leakage. These insulative electrode skirts are easy to make for and apply to square packs.

This cell stack includes anolyte and catholyte dividers in a simple arrangement of an inherently more complicated cell design.

DETAILED DESCRIPTION OF THE INVENTION

Figure 1:
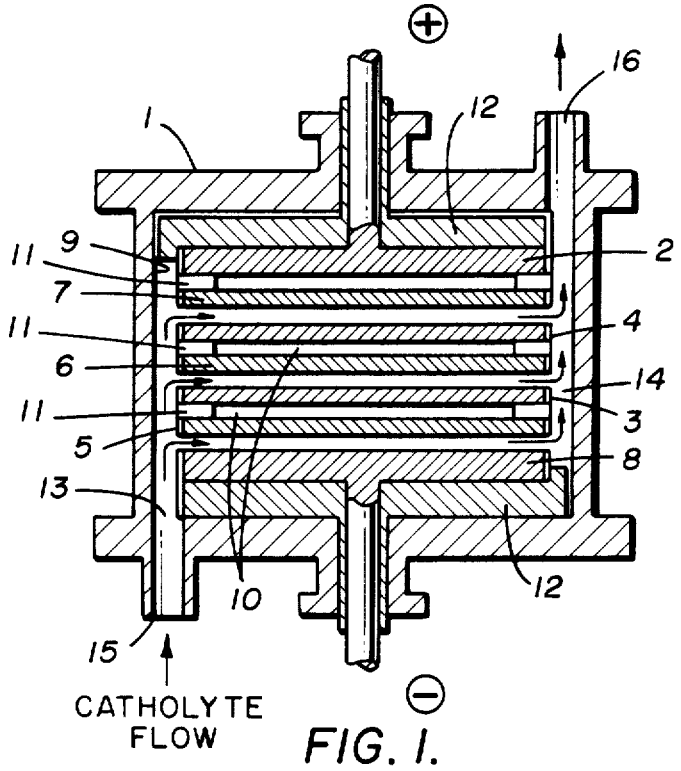
FIG. 1 is a schematic showing a vertical section of a preferred embodiment of this invention in which the cell is divided.

Referring now in detail to FIG. 1, electrochemical cell assembly 1 comprises single polar electrodes 2 and 8 and bipolar electrodes 3 and 4 stacked within the inner wall 9 of the assembly. Membranes 5–7 are alternately stacked between the electrodes. Between electrode 3 and membrane 5, electrode 4 and membrane 6, and electrode 2 and membrane 7 are spaces 10 which are maintained by parallel insulative spacers 11. Spacers 11 and alternate spacers (not shown) at right angles thereto along with terminal insulators 12 channel the anolyte from front to rear and the catholyte from left to right as shown by the arrows from entrance manifolds 13, through the channels shown and out through exit manifolds 14.

Figure 2:
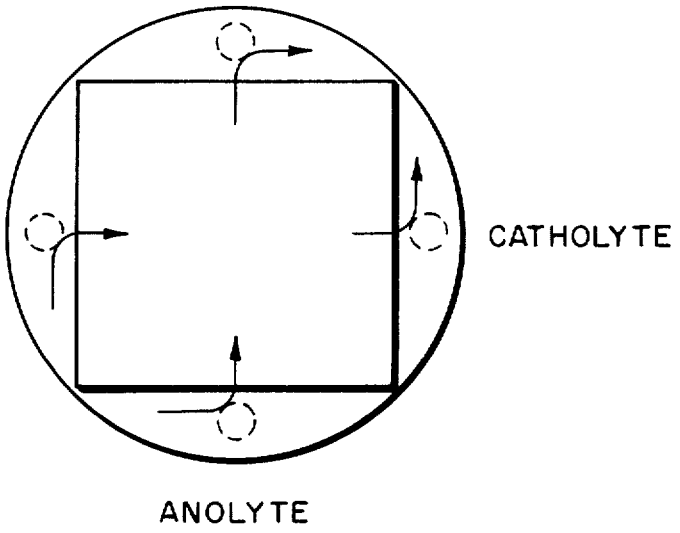
FIG. 2 is a non-sectional horizontal schematic showing the flow paths of both anolyte and catholyte.

Referring now to FIG. 2, the directions of anolyte and catholyte flow are shown more clearly in this non-sectional schematic.

In operation both anolyte and catholyte follow the arrows, with both entry and exit at opposite ends of the assembly. Flow of anolyte, as shown at FIGS. 1 and 2, is parallel to spacers and between electrodes 2 and membrane 7, electrode 4 and membrane 6, and electrode 3 and membrane 5 is from front to rear. The catholyte is introduced into the assembly at orifice 15 and withdrawn from the assembly at orifice 16.

I claim:

1. A divided electrochemical cell assembly comprising an essentially cylindrical electrolytic chamber having interior periferal walls, a plurality of stacked bipolar substantially square parallel planar electrodes and membranes so arranged within the chamber that each pair of one electrode and one adjacent membrane defines an electrolyte channel with alternating channels being anolyte channels and alternating channels being catholyte channels and that the corners and edges of the electrodes and membranes in juxtaposition with the interior periferal walls of the chamber define four electrolyte circulating manifolds, means for applying a direct current across the stack of electrodes, means for introducing catholyte at one side of the cylinder and into one of the manifolds, means for withdrawing the catholyte from one other manifold, means for exiting the catholyte at the opposite side of the cylinder from the catholyte introduction, and channeling and insulative spacer means comprising at least two spacers between and along the edges of each catholyte channel; means for introducing anolyte at another side of the cylinder and into another of said manifolds, means for withdrawing anolyte from another manifold, means for exiting anolyte at the opposite side of the cylinder from the anolyte introduction and channeling and insulative spacer means comprising at least two spacers between and along the edges of each anolyte channel.

2. The electrochemical cell assembly of claim 1 wherein alternating electrolyte channels are at right angles to one another.

3. The electrochemical cell assembly of claim 1 wherein a plurality of consecutive adjacent electrolyte channels are parallel.

4. The electrochemical cell assembly of claim 1 wherein alternating groups of electrodes and membranes with parallel electrolyte channels define electrolyte channels at right angles to one another.

* * * * *